US007040865B1

(12) United States Patent
Manos

(10) Patent No.: US 7,040,865 B1
(45) Date of Patent: May 9, 2006

(54) FAN SPACING COUPLER

(76) Inventor: Buddy J. Manos, 1595 Kale Adams, Warren, OH (US) 44481

( * ) Notice: Subject to any disclaimer, the term of this patent is extended or adjusted under 35 U.S.C. 154(b) by 0 days.

(21) Appl. No.: 11/022,743

(22) Filed: Dec. 28, 2004

(51) Int. Cl.
*F04D 29/64* (2006.01)

(52) U.S. Cl. ..... 416/169 A; 416/244 R

(58) Field of Classification Search ..... 416/146 R, 416/246, 171, 169 A; 403/299
See application file for complete search history.

(56) References Cited

U.S. PATENT DOCUMENTS 1,984,026 A * 12/1934 Little ..... 403/44
3,508,427 A 4/1970 Broderick
3,520,663 A 7/1970 Schertel
3,824,807 A * 7/1974 Hecht ..... 416/169 A
3,912,375 A 10/1975 Franklin, Sr.
4,193,740 A 3/1980 Charles
4,692,053 A 9/1987 Sampedro
5,938,405 A 8/1999 Coleman

* cited by examiner

*Primary Examiner*—Edward K. Look
*Assistant Examiner*—Richard A. Edgar

(57) ABSTRACT

A fan spacing coupler includes a tubular member that has a first end and a second end. The tubular member includes a first portion adjacent to the first end and a second portion adjacent to the second end. The first portion of the tubular member has an outer threaded surface and the second portion has an inner threaded surface. A water pump output shaft and a fan clutch coupling are provided. The output shaft is extended into the second portion and threadably couples the water pump to the tubular member. The first portion is extended into the clutch coupling and threadably is coupled to the clutch coupling so that the clutch coupling is mechanically coupled to the output shaft.

5 Claims, 2 Drawing Sheets

FAN SPACING COUPLER

BACKGROUND OF THE INVENTION

1. Field of the Invention

The present invention relates to fan coupling devices and more particularly pertains to a new fan coupling device for increasing a space between a fan clutch coupling and a water pump output shaft of an eight-cylinder engine.

2. Description of the Prior Art

The use of fan coupling devices is known in the prior art. U.S. Pat. No. 4,692,053 describes a device that allows for the connection of a drive fan to a water pump. An automotive fan space is shown in U.S. Pat. No. 3,520,663 and may be used for spacing of fans within particular vehicles.

While these devices fulfill their respective, particular objectives and requirements, the need remains for a device that may be retrofitted to existing water pump output shaft to a fan clutch coupling so that the fan clutch coupling is spaced from the output shaft. This will provide additional room between a fan and a water pump for after market alterations to the manifold, fuel system or carburetor of an eight-cylinder engine.

SUMMARY OF THE INVENTION

The present invention meets the needs presented above by generally comprising a tubular member that has a first end and a second end. The tubular member includes a first portion adjacent to the first end and a second portion adjacent to the second end. The first portion of the tubular member has an outer threaded surface and the second portion has an inner threaded surface. A water pump output shaft and a fan clutch coupling are provided. The output shaft is extended into the second portion and threadably couples the water pump to the tubular member. The first portion is extended into the clutch coupling and threadably is coupled to the clutch coupling so that the clutch coupling is mechanically coupled to the output shaft.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
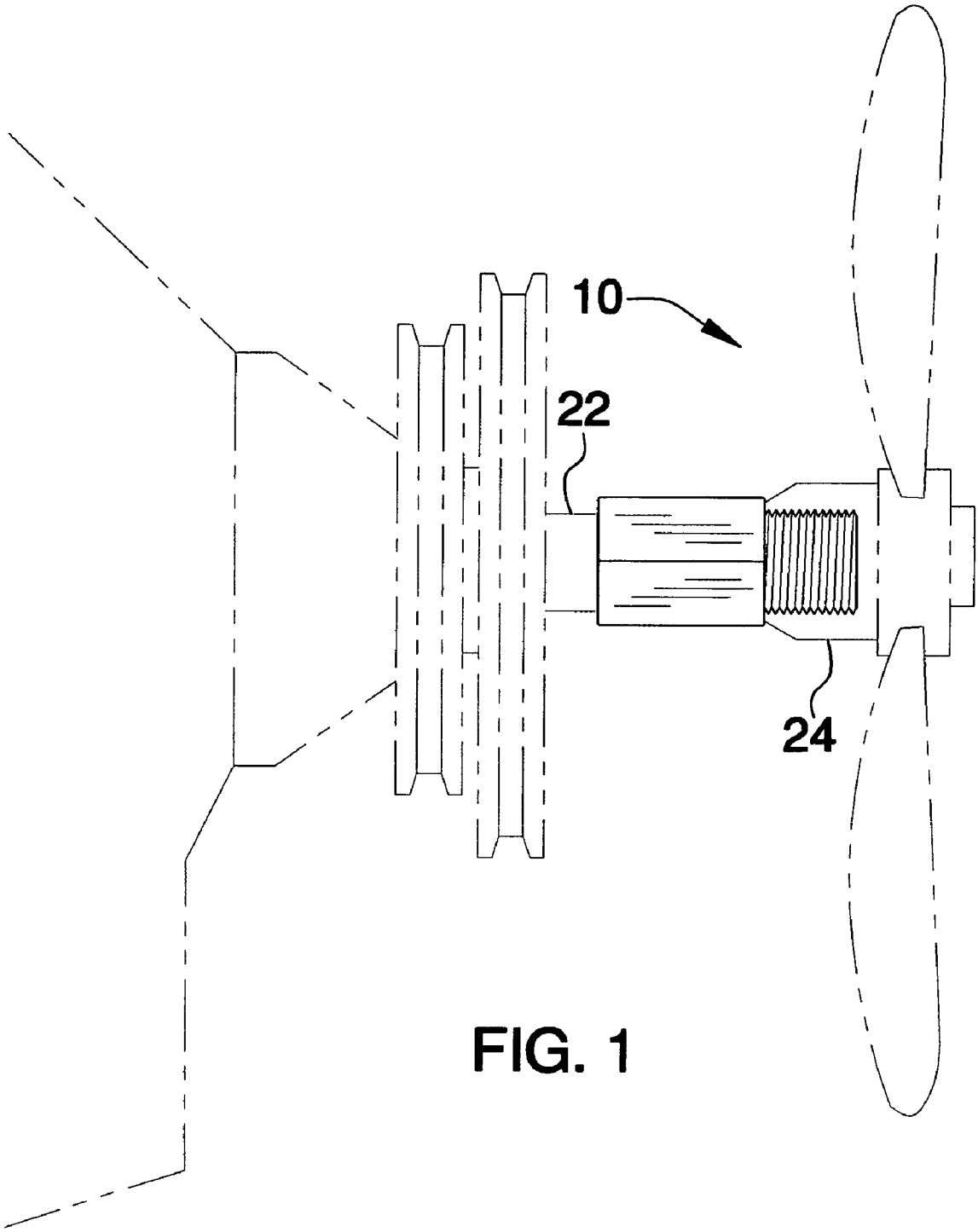
FIG. 1 is a side in-use view of a fan spacing coupler according to the present invention.
Figure 2:
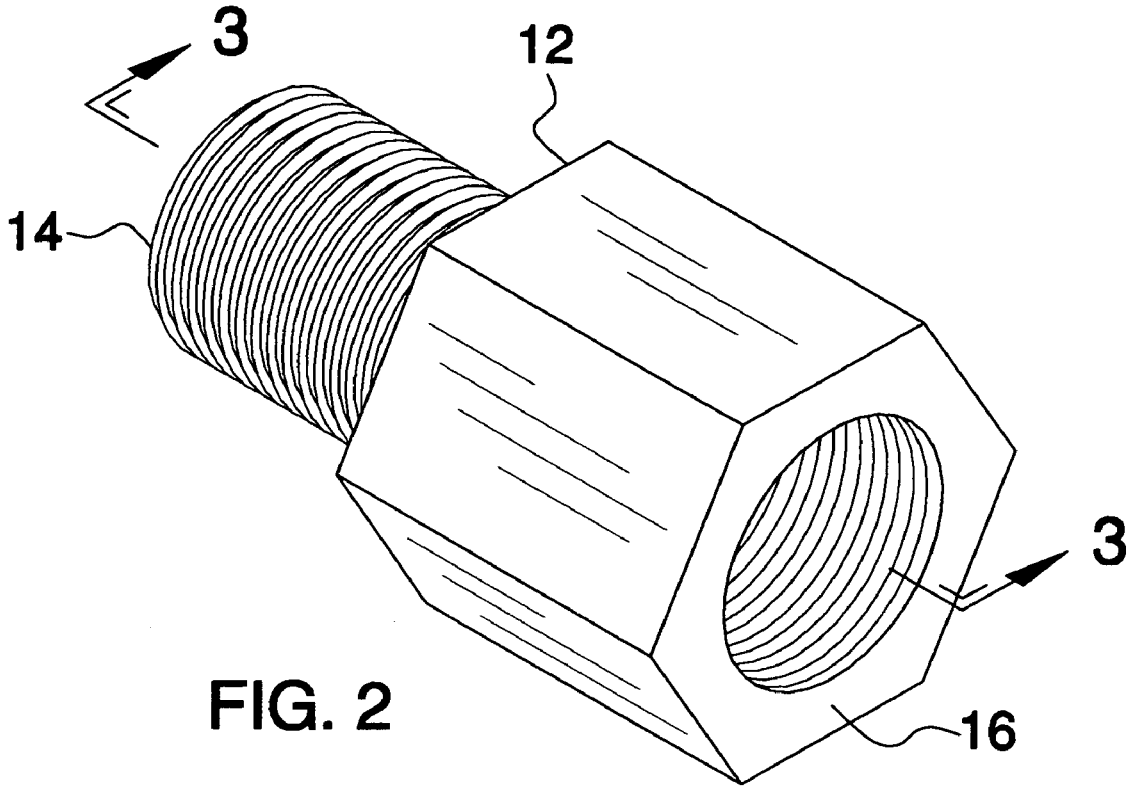
FIG. 2 is a perspective view of the present invention.
Figure 3:
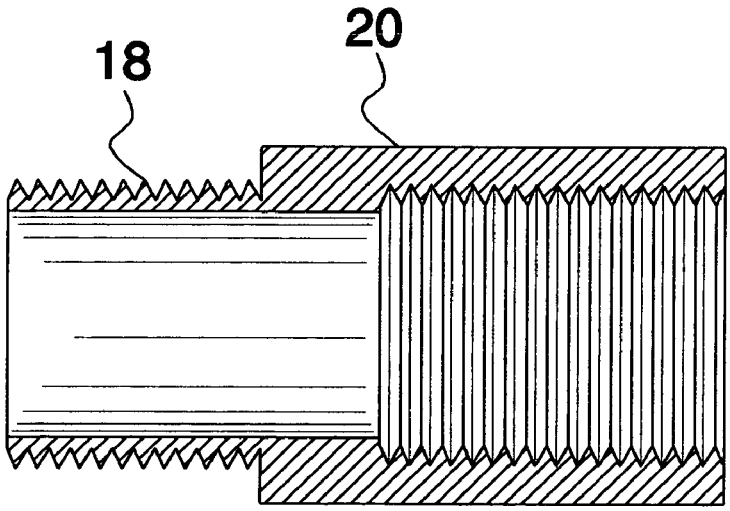
FIG. 3 is a cross-sectional view taken along line 3—3 of FIG. 2 of the present invention.

With reference now to the drawings, and in particular to FIGS. 1 through 3 thereof, a new fan coupling device embodying the principles and concepts of the present invention and generally designated by the reference numeral 10 will be described.

As best illustrated in FIGS. 1 through 3, the fan spacing coupler 10 generally comprises a tubular member 12 that has a first end 14 and a second end 16. The tubular member 12 includes a first portion 18 adjacent to the first end 12 and a second portion 20 adjacent to the second end 16. The first portion 18 of the tubular member 12 has an outer threaded surface. The second portion 20 has an inner threaded surface. The second portion 20 has an outer surface having a hexagonal cross-section taken perpendicular to a longitudinal axis of the tubular member 12. The tubular member 12 has a length substantially equal to two inches. The second portion 20 has a hexagonal cross-section taken perpendicular to a longitudinal axis of the tubular member 12.

A water pump output shaft 22 is extended into the first portion 18 and so that the output shaft 22 is threadably coupled to the tubular member 12. The second portion 20 is extended into a fan clutch coupling 24 so that the clutch coupling 24 is threadably coupled to the tubular member 12 and mechanically coupled to the output shaft 22.

In use, the tubular member 12 allows for space between a fan and a water pump for modifications that are made to V-8 engines and in particular Chevy Vortec engines. Aftermarket modifications, such as those to the manifold, carburetor or fuel-injection system, require this additional space between the fan and the water pump.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of extending a distance between a water pump and a fan clutch comprising the steps of:

providing a tubular member having a first end and a second end, said tubular member including a first portion adjacent to said first end and a second portion adjacent to said second end, said first portion of said tubular member having an outer threaded surface, said second portion having an inner threaded surface;

providing a water pump output shaft;

providing a fan clutch coupling;

extending said output shaft into said second portion and threadably coupling said output shaft to said tubular member; and extending said first portion into said clutch coupling and threadably coupling said clutch coupling to said tubular member such that said clutch coupling is mechanically coupled to said output shaft.

2. The method according to claim 1, wherein said second portion has an outer surface having a hexagonal cross-section taken perpendicular to a longitudinal axis of said tubular member.

3. The method according to claim 1, wherein said tubular member has a length substantially equal to two inches.

4. The method according to claim 1, wherein said second portion has an outer surface having a hexagonal cross-section taken perpendicular to a longitudinal axis of said tubular member.

5. A method of extending a distance between a water pump and a fan clutch comprising the steps of:

providing a tubular member having a first end and a second end, said tubular member including a first portion adjacent to said first end and a second portion adjacent to said second end, said first portion of said tubular member having an outer threaded surface, said second portion having an inner threaded surface, said second portion having an outer surface having a hexagonal cross-section taken perpendicular to a longitudinal axis of said tubular member, said tubular member having a length substantially equal to two inches;

providing a water pump output shaft;

providing a fan clutch coupling;

extending said output shaft into said second portion and threadably coupling said output shaft to said tubular member; and extending said first portion into said clutch coupling and threadably coupling said clutch coupling to said tubular member such that said clutch coupling is mechanically coupled to said output shaft.

* * * * *